United States Patent [19]

Swartz

[11] 4,008,534

[45] Feb. 22, 1977

[54] ROTATING DISPLAY WITH BLACK LIGHT ILLUMINATION

[76] Inventor: Gordon P. Swartz, 22945-A Nadine Circle, Torrance, Calif. 90505

[22] Filed: Sept. 22, 1975

[21] Appl. No.: 615,551

[52] U.S. Cl. ..... 40/106.52; 40/130 R; 40/33

[51] Int. Cl.[2] ..... G09F 13/34

[58] Field of Search ..... 40/106.51, 106.52, 106.53, 40/130 K, 130 R, 130 F, 33, 77; 240/10 R, 10.1

[56] References Cited

UNITED STATES PATENTS

| | | | |
|---|---|---|---|
| 2,196,424 | 4/1940 | Musaphia | 40/106.52 |
| 2,867,716 | 1/1959 | Ream | 40/77 |

FOREIGN PATENTS OR APPLICATIONS

| | | | |
|---|---|---|---|
| 162,666 | 11/1922 | United Kingdom | 240/10.1 |

*Primary Examiner*—Hugh R. Chamblee
*Assistant Examiner*—John H. Wolff
*Attorney, Agent, or Firm*—Poms, Smith, Lande & Glenny

[57] ABSTRACT

A rotating display having a plurality of display members connected by support elements, the display members being of progressively larger sizes, nested one within another to form an array. Each display member has many open areas, preferably being made of angularly spaced wire meridians formed in a generally spherical shape, so that the inner display members are at least intermittently visible to an observer during rotation of the array on a driven shaft coupled to the outermost display member. The structural elements of each display member are colored, preferably with fluorescent pigments of various hues creating a varicolored dynamic visual impression when illuminated by ultraviolet or "black" light during shaft rotation. The support elements are preferably made of thin flexible wire virturally invisible when the display is so illuminated, the flexibility of the support elements permitting random movement of the display members relative to one another during rotation of the array. A source of ultraviolet light illuminates the array, and adjustable frequency power supply means may be provided to energize the light source, so that the user can create stroboscopic variations in the visual impression produced by the rotating display.

10 Claims, 6 Drawing Figures

ROTATING DISPLAY WITH BLACK LIGHT ILLUMINATION

BACKGROUND AND SUMMARY OF THE INVENTION

The present invention relates generally to display devices, and more particularly to a dynamic display assembly of interconnected display members colored in various hues with fluorescent pigment, and designed to be illuminated by a source of ultraviolet light.

In its preferred form herein shown and described, the invention includes a base having mounted therein a drive means such as an electric motor for rotating a vertically oriented upwardly projecting shaft having a stub on which the display assembly proper is mounted. The display assembly or array includes a number of display members, here illustratively three, each consisting of a framework of circular elements which may be in the form of stiff wire coated with a fluorescent material, the several circular elements of each display member desirably having a different hue. Thus a display member is generally spherical in shape, with the circular wire elements constituting meridians of the sphere. The elements of the largest display member are fixed at one of their intersections, constituting a pole of the sphere, to the stub shaft.

Within the largest display member is a smaller display member, desirably similar to the outer display member just described except as to size. The second display member is supported by the first, or outer, display member by a flexible support element such as a thin wire or the like, which itself is not coated by any pigment, and which is therefore substantially invisible when the display assembly is illuminated by ultraviolet light. The flexible support elements extends from one pole of the first display member to a pole of the second display member.

A third display member, smaller than the second display member but otherwise similar thereto, may be received within the second display member and supported thereby through a similar flexible support element such as a thin wire extending from a pole of the second display member to a pole of the third display member.

The display array as thus assembled and mounted on the shaft stub is then rotated by rotation of the shaft while being illuminated only by a source of ultraviolet light, desirably housed in the base of the device. Since each of the display members, being essentially a skeleton of meridians, includes a multiplicity of openings, it will be understood that the inner second and third display members above described will be at least intermittently visible to the observer during rotation of the shaft and display array. The inner display members may remain generally concentric with the outermost display member during rotation, or the inner display members may move through random eccentric paths during rotation. The resulting appearance is striking and arresting, and the effect can be further heightened by stroboscopically varying the exciting frequency of the ultraviolet light source.

It is accordingly a principal object of the present invention to provide and disclose a novel dynamic display. Other objects of the invention are to provide, in such a display, a plurality of nested display members, the display members being provided with a multiplicity of openings whereby the inner display members are at least intermittently visible to the observer; to provide in such a structure display members made up of meridians of a sphere, the meridians being coated with a fluorescent material, and including an ultraviolet light source; to provide in such a structure flexible elongated support elements attached at either of their ends to the pole portions of adjacent display members; to provide in such a structure means for stroboscopically varying the frequency of excitation of the ultraviolet light source; and for other and additional purposes as will be understood from a reading of the following description of a preferred form of the invention, taken in connection with the accompanying drawings.

DETAILED DESCRIPTION

Figure 1:
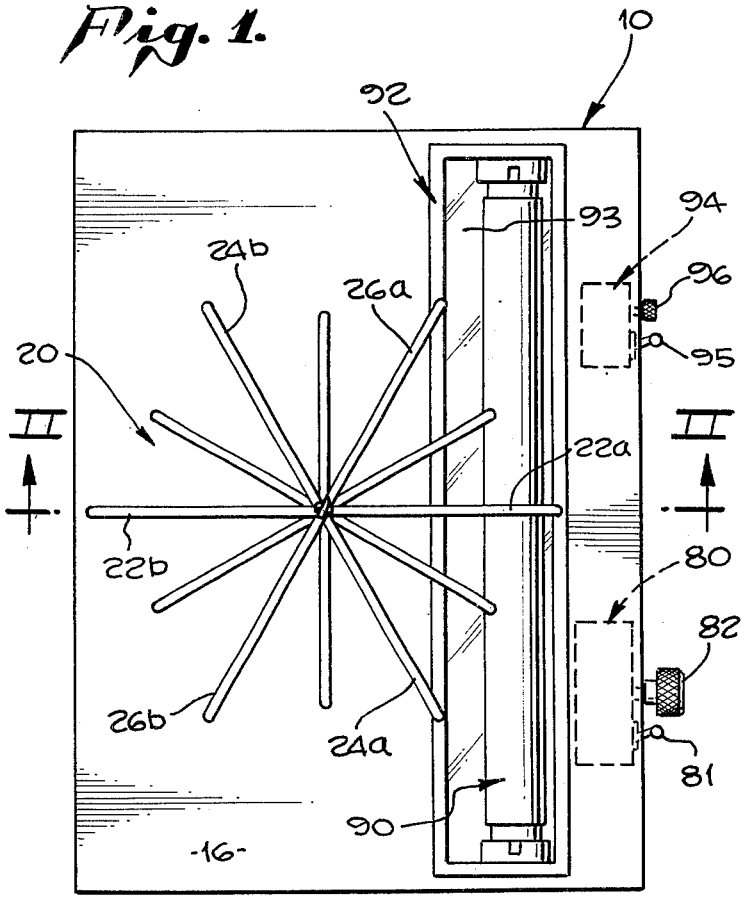
FIG. 1 is a vertical plan view of a display in accordance with the present invention.
Figure 2:
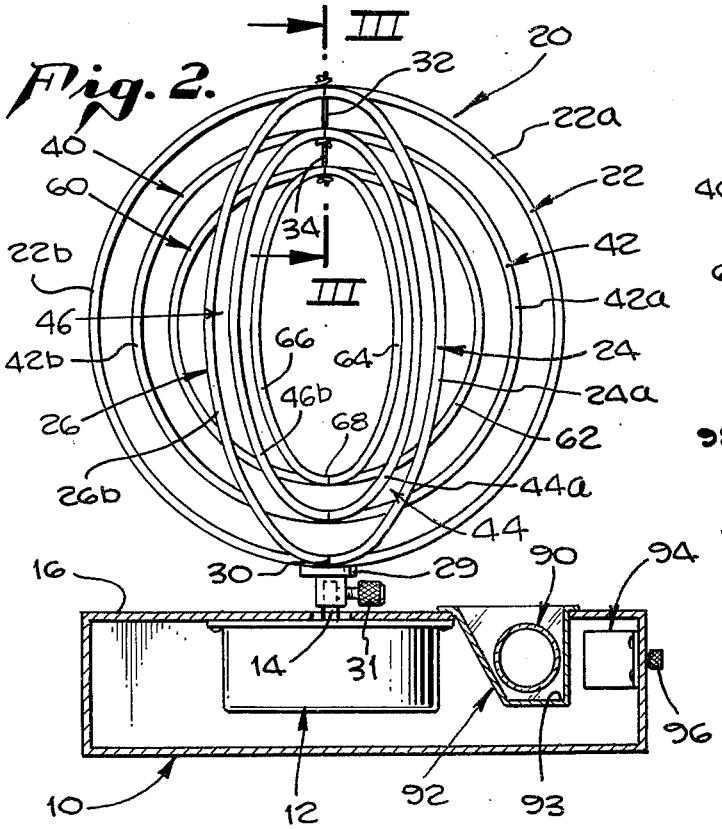
FIG. 2 is a side elevational view, partially in section, taken on line II—II of FIG. 1, with corresponding meridians of the display members being in coplanar relation.

Referring first to FIGS. 1 and 2, a base indicated generally at 10 and desirably generally rectangular in shape has mounted therein a motor indicated generally at 12 for driving a vertically oriented upwardly projecting shaft stub 14, the shaft being located generally centrally of the upper wall 16 of the base.

The present illustrative form of the invention includes three display members, of which the largest is indicated generally at 20. Display member 20 is generally spherical as shown and is made up of a number of angularly spaced circular elements, there being three such circular elements in the present form of the invention indicated generally at 22, 24 and 26. Each circular element effectively provides a pair of diametrically opposed meridians, **22*a* and 22*b*, 24*a* and 24*b*, and 26*a* and 26*b*** respectively. The circular elements are angularly spaced from one another, desirably equally, thus forming dihedral angles at 60° between adjacent meridians.

The meridians may be made of any suitable material having sufficient stiffness to maintain their shape when formed, such as stiff metal wire, and the meridians are joined together at the upper and lower poles 28 and 30 respectively, as by welding, brazing or the like. Thus the construction provides open areas between meridians, so that inner display members described below are at least intermittently visible to the observer. At pole 30, display member 20 is fixed as by welding to a tubular fitting 29 receiving the upper end portion of shaft stub 14 and attached thereto by set screw 31.

Figure 3:
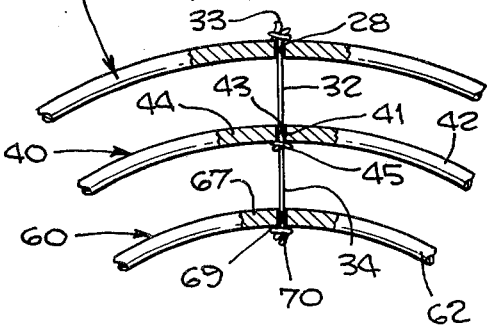
FIG. 3 is a fragmentary view, partially in section, taken on the arrows III—III of FIG. 2.

Means are provided in accordance with the invention for supporting one or more smaller display members within display member 20, and in the present embodiment of the invention, such means include an elongated support element 32 such as a thin wire or small cable having its upper end 33 fixed to display member 20 at its pole 28, as best seen in FIG. 3.

Support element 32 supports a second display member indicated generally at 40. More specifically, display member 40 includes a plurality of circular elements indicated generally at 42, 44 and 46, which may be formed and spaced similarly to the circular elements 22, 24 and 26 previously described, each element thus providing two meridians of smaller radius than the meridians of member 20. At the pole 41, circular element 42 may be provided with a bore 43, through which extends elongated support element 32, the latter being provided with a knot 45 of larger size than bore 43, in order to support circular element 42 and thereby the entire second display member 40.

Referring to FIG. 2, meridians 42*a*, 42*b*, 44*a* and 46*b* are visible, and all six of the meridians of display member 40 are angularly spaced from one another, preferably equally so that the dihedral angle between adjacent meridians is 60°, as in the case of display member 20 previously described. It is thus characteristic of the second display member 40, as was also described in connection with first display member 20, that there are large open areas or spaces between adjacent meridians of display member 40, thus permitting a third display member to be now described to be at least intermittently visible to the observer.

Thus a third display member indicated generally at 60 is constructed in substantially the same manner as display members 20 and 40 previously described, having circular elements 62, 64 and 66, each comprising coplanar semicircular meridians angularly spaced from one another desirably by equal angles, thus forming 60° dihedral angles between adjacent meridians, the meridians intersecting at an upper pole 67 and a lower pole 68, the meridians being fixed to one another at these poles as by welding, brazing or the like in the manner previously described in connection with display members 20 and 40.

Third or inner display member 60 is supported by display member 40, preferably by a downwardly extending prolongation of elongated display element 32. With particular reference to FIG. 3, that prolongation is indicated at 34, and extends downwardly from knot 45 and passes through a bore 69 formed in circular element 62 at pole 67. Immediately below the bore, prolongation 34 of the elongated support element 32 is tied in a knot 70, or is otherwise provided with an enlarged portion, so that it cannot pass upwardly through bore 69, and thereby supports inner display member 60.

In the preferred form of the present invention, the circular elements making up each of the display members are coated with bright pigments, preferably of different hues among the several circular elements of a display member, and even of different hues among the meridians. Thus, as seen in FIG. 1, meridian 22*a* of circular element 22 may be orange in hue, 22*b* blue, 24*a* red, 24*b* purple, 26*a* green and 26*b* yellow. The individual meridians of display members 40 and 60 are desirably similarly vari-hued.

Driving motor 12 receives electrical power via a control box indicated generally at 80 housed in base 10 and provided with an off-on switch 81 and, if motor 12 is of the variable speed type, a speed adjusting knob 82, adapted to control a rheostat or equivalent circuit element.

A light source indicated generally at 90 is mounted in base 10, desirably in a trough indicated generally at 92, whose inner walls 93 are preferably reflective, in order to enhance the amount of light projected by the light source 90 upwardly onto the display. In the preferred form of the invention, the several meridians of the display members are coated with fluorescent pigments, and light source 90 produces ultraviolet radiation, or so-called black light, which in known manner causes the fluorescent pigments to glow even in the absence of radiation in the visible portion of the spectrum. Means are provided for controlling the supply of electrical power to light source 90, including a control box or unit indicated generally at 94, mounted in the front wall of base 10, and including an off-on switch 95 and a rotatable knob 96 for adjusting the frequency of the AC power supplied to the light source, in order to achieve a stroboscopic effect during operation of the present invention.

Figure 4:
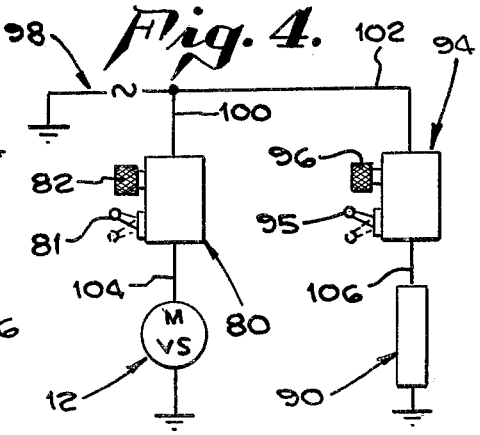
FIG. 4 is a simplified circuit diagram of the display.

The electrical elements and controls of the present invention will be further understood by reference to FIG. 4, in which an AC power source indicated generally at 98 supplies power through lines 100 and 102 to motor control unit 80 and light control unit 94 respectively. As will be seen, power from each of the control units is fed via lines 104 and 106 to the respective motor 12 and light source 90.

Figure 5:
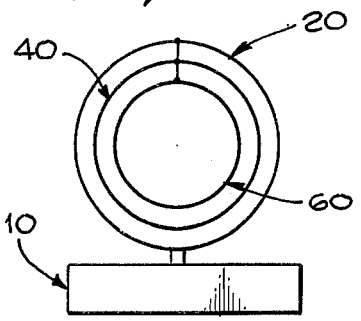
FIG. 5 is a side view on a small scale of the display array at rest, the display member being shown in concentric relation.
Figure 6:
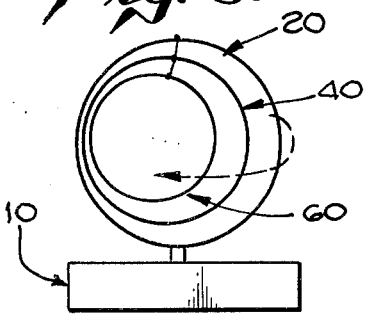
FIG. 6 is a view similar to FIG. 5, except showing the display members in a typical position during rotation.

FIGS. 5 and 6 show variations in the relative locations of the several display members during operation of the present device. In FIG. 5, the spherical outlines of the three display members are shown substantially concentric to one another. This is the situation when the present device is at rest, and also during operation at relatively slow speeds of the driving motor 12 approximately 100 rpm or less. In FIG. 6, the inner display members 40 and 60 are displaced into eccentric positions relative to outer display member 20. This is the condition which the inner display members 40 and 60 tend to assume during relatively rapid rotation of driving motor 12, well above 100 rpm. This is caused by centrifugal force and results from the flexibility of the elongated support element 32 and its prolongation 34 which support display members 40 and 60 respectively. Furthermore, because support element 32 and prolongation 34 are portions of wire which is thin enough to be easily twistable about its own axis, the momentum of the inner display members 40 and 60 will tend to make the rotational movement of those display members lag relative to the rotational movement of outer display member 20, especially immediately following a change of motor speed.

Accordingly, while motor 12 is rotatably driving outer display member 20, the visual effect upon the observer of that movement of display member 20 and the comparatively random movements of display members 40 and 60 is very impressive. This effect is enhanced when, in accordance with the preferred form of the invention, there is little or no ambient visible light and light source 90 produces ultraviolet radiation causing the meridians of the several display members to fluoresce or glow. All other components of the device are desirably virtually invisible, including the elongated support element 32 and its prolongation 34.

The frequency of the AC power energizing light source 90 may be controlled, as above described, by the user's adjusting control knob 96. When the frequency is about 60 Hz or higher, with little or no ambient visible light, the device appears to be a rotating multi-colored sphere. At a lower frequency, from about 50 Hz down to about 10 Hz or even less, the display members become individually visible, and from a display resembling the conventional showing of electrons revolving about an atomic nucleus. Also, at such lower frequencies, the device exhibits a striking effect when the observer views the device alternately, monocularly and binocularly. When viewed binocularly, the device under typical conditions appears to rotate in its true direction, but when viewed monocularly it appears to reverse its direction of rotation.

In a more elaborate system, it is contemplated that the energizing frequency may be varied automatically as a function of a characteristic of accompanying music, such as by the amplitude or rhythm of the music, by the use of known components which form no part of the present invention as such.

I claim:

1. A dynamic display comprising:

a first display member having a central axis terminating at upper and lower poles and comprising a plurality of elongated display elements each extending from one pole to the other and, therebetween, being spaced radially outwardly from said axis and angularly from one another;

a second display member disposed within said first display member and having a central axis shorter than the first named axis terminating in upper and lower poles, said second display member comprising a plurality of elongated display elements each extending from one of said second named poles to the other and, therebetween, being spaced radially outwardly from said second axis and angularly from one another;

a thin elongated flexible support element fixed at one end to the upper pole of the first display member and at its other end being supportingly attached to the upper pole of the second display member;

and means for rotating said first display member about its axis.

2. The invention as defined in claim 1 wherein said rotating means include a motor and output shaft coupled to a pole of said first display member.

3. The invention as defined in claim 2 including a base housing said motor and shaft, and wherein the shaft is coupled to the lower pole of the first display member.

4. The invention as defined in claim 3 wherein said display elements are coated with fluorescent pigment, and including a source of ultraviolet light mounted in said base and illuminating the display elements.

5. The invention as defined in claim 4 wherein each display element is circular in shape, comprising a pair of coplanar meridians.

6. The invention as defined in claim 1 wherein each of the display elements of the first display member are circular in shape, comprising a pair of coplanar meridians.

7. The invention as defined in claim 6 wherein said display elements are coated with fluorescent pigment, and including a source of ultraviolet light for illuminating the display members.

8. The invention as defined in claim 7 wherein said meridians are equally angularly spaced about the axis of the first display member, and the pigments of successive meridians are of differing hues.

9. The invention as defined in claim 7 wherein said ultraviolet light source is energized by alternating current, and including means for selectively adjusting the frequency of said alternating current.

10. The invention as defined in claim 9 including means for selectively adjusting the speed of rotation of said first display member.

* * * * *